United States Patent [19]

Adler et al.

[11] Patent Number: 4,692,660

[45] Date of Patent: Sep. 8, 1987

[54] IMPROVED INDEXING MEANS WITH OPTIMIZED GROOVE ANGLE

[75] Inventors: Robert Adler, Northfield; Paul Strauss, Chicago, both of Ill.

[73] Assignee: Zenith Electronics Corporation, Glenview, Ill.

[21] Appl. No.: 831,697

[22] Filed: Feb. 21, 1986

[51] Int. Cl.[4] ..... H01J 29/86; H01J 9/24

[52] U.S. Cl. ..... 313/477 R; 445/23

[58] Field of Search ..... 313/477 R, 407; 220/2.1 A, 2.3 A; 445/3, 23

[56] References Cited

U.S. PATENT DOCUMENTS 4,547,696 10/1985 Strauss ..... 313/477 R X

FOREIGN PATENT DOCUMENTS 2353745 9/1974 Fed. Rep. of Germany ... 313/477 R

*Primary Examiner*—David K. Moore
*Assistant Examiner*—K. Wieder
*Attorney, Agent, or Firm*—Ralph E. Clarke, Jr.

[57] ABSTRACT

Indexing means are disclosed for use in the indexing of components having planar mating areas. The indexing means comprising three V-grooves located in the mating area of a first of said components, and three indexing protuberances fixed in the mating area of a second of said components in apposition to said V-grooves for mating in registration with said V-grooves. The indexing means according to the invention are characterized by the grooves each having a subtended angle in the range of 34 to 75 degrees, and preferably, 53 degrees. The indexing means according to the invention are especially suited for application to television manufacturing, particularly in the precision indexing components of a color cathode ray tube having a tension foil shadow mask. 2CRT61M

12 Claims, 8 Drawing Figures

IMPROVED INDEXING MEANS WITH OPTIMIZED GROOVE ANGLE

CROSS REFERENCE TO RELATED APPLICATIONS AND PATENTS

This application is related to, but is no way dependent upon, applications Ser. No. 572,088 now U.S. Pat. No. 4,547,696; Ser. No. 572,089 filed Jan. 18, 1984 now U.S. Pat. No. 4,595,857; Ser. No. 729,015 filed May 17, 1985; Ser. No. 735,887 filed Aug. 8, 1984; Ser. No. 727,486 filed Apr. 26, 1985; Ser. No. 758,174, filed July 23, 1985; Ser. No. 743,184 filed June 10, 1985; Ser. No. 754,786 filed July 12, 1984; Ser. No. 757,174 filed July 23, 1985; Ser. No. 832,493 filed Feb. 21, 1986, Ser. No. 831,696 filed Feb. 21, 1986 and Ser. No. 832,556 filed Feb. 21, 1986; all of common ownership herewith.

BACKGROUND OF THE INVENTION

1. Definitions

As used herein, the term "indexing" means the process of locating and aligning one component with another in precise, repeatable registration; e.g., the faceplate of a cathode ray tube with the tube funnel.

The term "indexing means" is the means used for registering one component with another.

The term "V-shaped groove" means a groove used in indexing, and shaped in cross-section similarly to a capital "V". The section of the groove not in contact with the associated ball; i.e., the bottom of the groove, may be rounded.

The term "register" or "registration" means the aligning or "indexing" of one component with another.

The term "angle" refers to the included or subtended angle of a V-groove used in indexing. It is also referred to as a "wedge angle."

2. Field of the Invention

This invention relates generally to means for the mechanical registration of one component with another. This invention is especially useful for precisely indexing the shadow mask or mask frame of a color cathode ray tube with other tube components, especially components in tubes having a tension foil shadow mask. The indexing means according to the invention may also be used for precisely indexing the shadow mask component of a color cathode ray tube with the associated faceplate during the photoscreening of phosphors on the faceplate.

3. Art

The following are being submitted to the Patent and Trademark office for evaluation as to their possible relevance to the claimed subject matter. It is believed to be the closest of the art available, but the applicants make no admission as to the fact of its being "prior art," to its relevance in fact, to its legal sufficiency, or to its priority in time, nor do applicants represent that no better art exists.

(a) Procedures in Experimental Physics. I. Strong et al. N.Y.: Prentice-Hall. 1938. Pp. 585–6. Description of kinematic designs for positioning various elements of an instrument.

(b) "The CBS-Colortron: A Color Picture Tube of Advanced Design." N. Fyler et al. Proc. of the IRE. Jan, 1954. Dec. Class. R583.6. Pp. 326–334. A shadow mask has three projecting springs with V-grooves at the ends which are perpendicular to the tube axis. Glass studs projecting from the faceplate provide for receiving the V-grooves to align mask and faceplate.

(c) U.S. Pat. No. 3,894,321 to Moore. (1) Alignment holes in the corners of a shadow mask mate with alignment nipples in a faceplate. The nipples pass through the holes to fit into funnel recesses. (2) For faceplate photo-screening, a mask is stretched on a frame, and the mask is registered with the faceplate by alignment holes in the mask which mate with alignment posts. (3) A frame supporting a shadow mask is held in registration by resting against alignment posts on a tilted bed.

(d) U.S. Pat. No. 4,100,451 to Palac. Describes the suspension of a non-self-rigid domed shadow mask with respect to a faceplate by four suspension means which provide for coupling and indexing the mask directly to corner portions of the faceplate. In one embodiment the indexing means comprises legs having rounded portions which engage indexing cavities in the faceplate which may be in the form of V-grooves or slots. Another approach utilizes V-blocks at the four corners of the faceplate, each of which has a clamp attached to the mask, and each clamp has a foot for mating with a V-block.

(e) U.S. Pat. No. 4,547,696 to Strauss. A tension mask supporting and registration system is disclosed in which balland-groove indexing means are utilized.

(f) U.S. Pat. No. 2,961,560 to Fyler. A color picture tube is described in which a flat shadow mask is registered with a face panel by indexing means.

(g) U.S. Pat. No. 2,733,366 to Grimm et al. A target assembly is disclosed for a color kinescope. A planar shadow mask is held in tension in a metal frame. The frame and the associated mask is held in registration with the faceplate and the phosphor pattern deposited on the faceplate. Means for registration and assembly of the frame and faceplate is indicated as comprising three metal support posts extending from the frame. The support posts have rounded metal terminations which are shown as being seated in respective cavities in the faceplate.

Shortcomings of the Prior Art

Among the problems, defects or other drawbacks found in the prior art are the following:

1. The textbook description, Item (a), provides no instruction as to how various components of a cathode ray tube may be indexed for photoscreening and assembly, nor does it provide details of groove configurations and dimensions.
2. The component-registration means disclosed by Moore and the others is considered to be too imprecise and impractical for the manufacture of a color cathode ray tube having a tension foil shadow mask.
3. The disclosure of Grimm et al, Item (g), provides little detail of the registration means directly relevant to the present invention.
4. The problem with which the present invention is concerned--ball hang up (or protuberance hang up) in indexing means--is not addressed.

FEATURES, ADVANTAGES AND OBJECTS OF THE INVENTION

Among the features, advantages and objects of the invention are the following:

1. Providing an improvement in the means for precisely and repeatedly registering one component with another.
2. Providing an improvement in the means for registering major components of a cathode ray tube with an internal shadow mask.
3. Providing an improvement in cathode ray tube component indexing means, one that will facilitate manufacture.
4. Providing an improved component indexing means which will ensure precision and repeatability in mask-to-faceplate registration during the photoscreening process.
5. Providing V-groove indexing means in which the ball elements will not hang up, and which will provide positive, repeatable registration of components during manufacture.

BRIEF DESCRIPTION OF THE DRAWINGS

The figures comprise pictorial background information and a representation of the preferred embodiment.

DESCRIPTION OF THE PREFERRED EMBODIMENT

Figure 1:
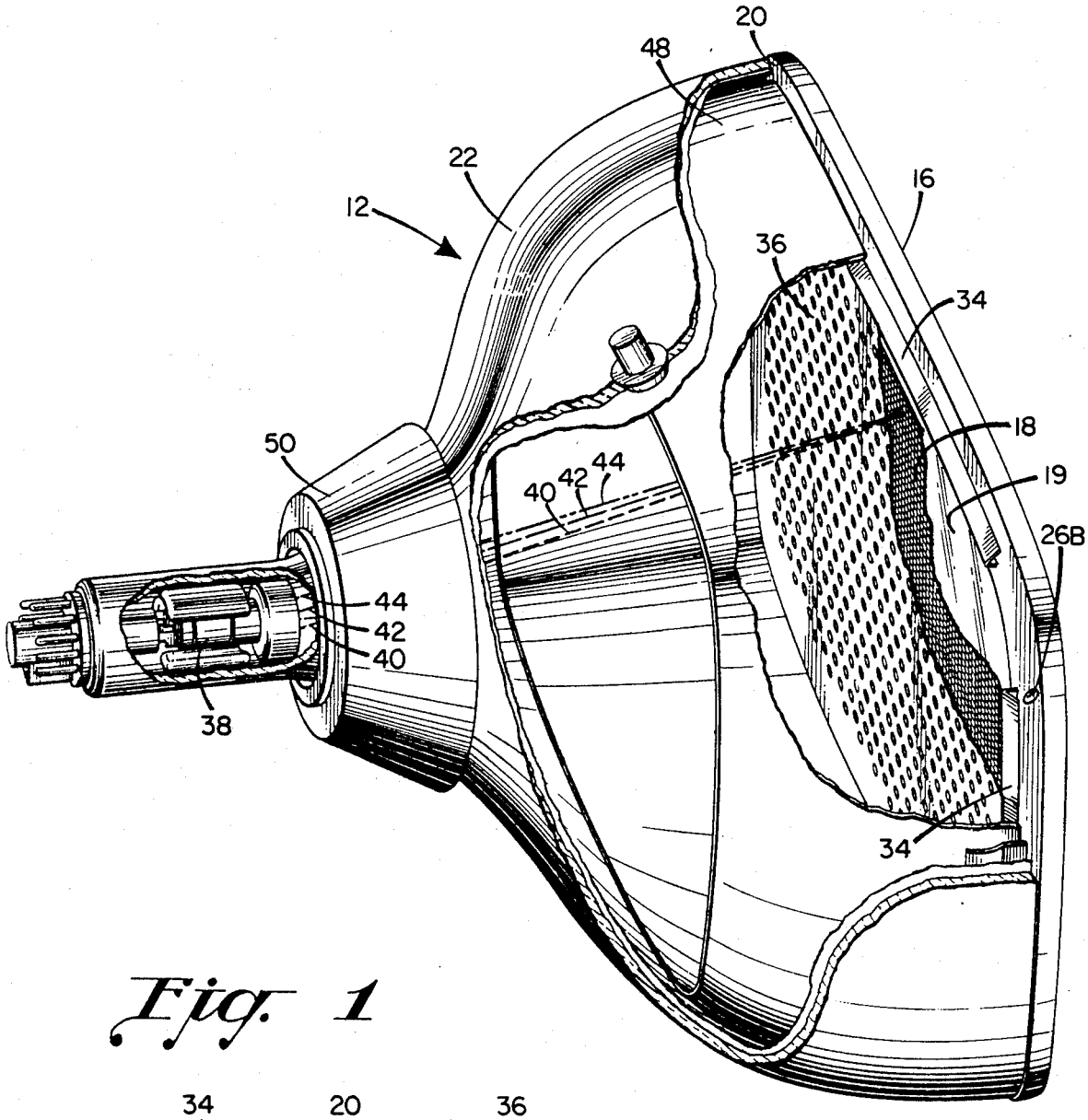
FIG. 1 is a perspective view of the partly cut away envelope of a color cathode ray tube having a tension foil shadow mask in which the indexing means according invention can find useful application.

This specification includes a description of the invention, the best mode presently contemplated for carrying out the invention, and appended claims.

The components of the invention are disclosed in the drawings and are identified and described in the following paragraphs in this sequence: a reference number, a reference name, and a brief statement of interconnections, relationship, functions, operation, and/or result, as appropriate.

Figure 1A:
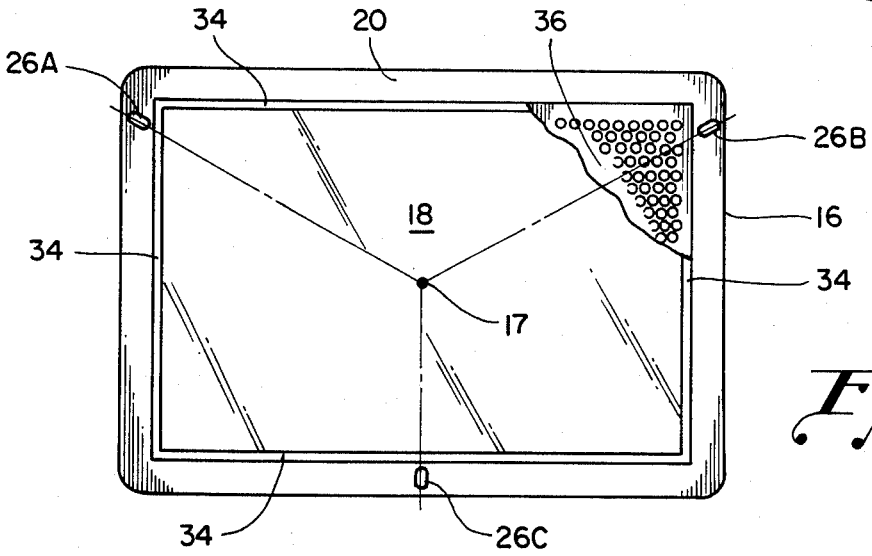
FIG. 1A is a plan view of the inner surface of the faceplate of FIG. 1 showing the location of components of the indexing means in relation to the faceplate.
Figure 2:
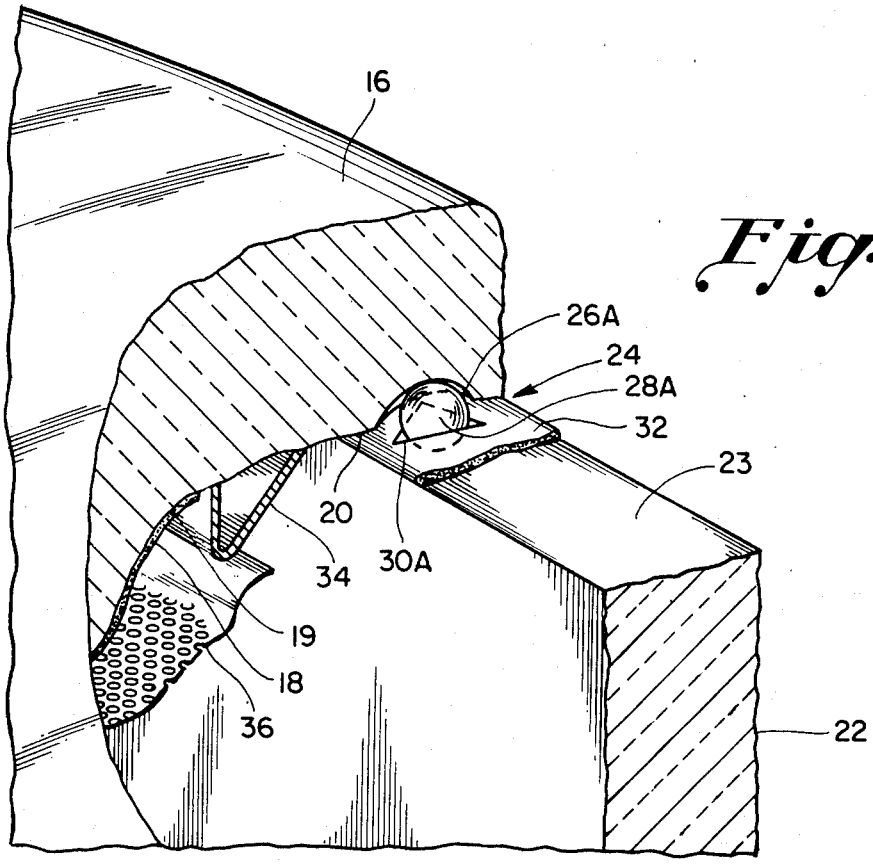
FIG. 2 is an enlarged cut-away view in perspective of a section of the tube of FIG. 1 depicting the indexing means according to the invention in relation to such tube components as a faceplate, a funnel and a shadow mask.

(With specific reference to FIGS. 1, 1A and 2)

12 color cathode ray tube.

16 faceplate.

17 centerpoint of faceplate.

18 screen. Comprises phosphor deposits.

19 aluminum film. Overlays phosphor deposits on screen 18.

20 faceplate sealing area.

22 funnel.

23 funnel sealing area.

24 indexing means.

One of the three indexing means according to the invention shown at the junction of a faceplate and a funnel. The components of the indexing means are listed as follows

26A, 26B, 26C V-grooves. These grooves, depicted as being three in number, are preferably angularly spaced in the sealing area 20 of the faceplate 16 and with their major axes approximately radially oriented with respect to the centerpoint 17 of faceplate 16.

28A, 28B, 28C ball means. Semi-fixed elements that provide for aligning and orienting the V-grooves 26A, 26B and 26C with the recesses 30A, 30B and 30C. These can as well be according to the invention rounded protuberances extending from and permanently fixed in a sealing area.

30A, 30B, 30C cavities. For receiving and fixing the ball means in integral relationship with one or the other of the components being indexed. The cavities are noted as being recesses in the form of trihedrals for three-point contact with the ball means. The cavities could as well be conical depressions.

NOTE: The components depicted could as well be reversed; that is, the cavities could be located in the faceplate, and the Vgrooves in the funnel.

NOTE: Means for fixing the indexing balls is described and claimed in referent copending application Ser. No. 743,184, of common ownership herewith. According to that disclosure, an assembly-in-process is characterized by the use of temporary cementing means for attaching the balls to associated V-grooves whereby the components can be reproducibly registered and reregistered in precise relationship during screening, and later in final assembly of the tube.

32 layer of frit. 34 shadow-mask support structure. An improved structure for supporting a tension foil shadow mask. The structure depicted is not a subject of the present application, but is fully described and claimed in referent copending application Ser. No. 832,556.

36 shadow mask. A tension foil shadow mask having a thickness of 1 mil or less, by way of example.

38 electron gun.

40, 42, 44 electron beams.

48 internal magnetic shield.

50 yoke.

Figure 3:
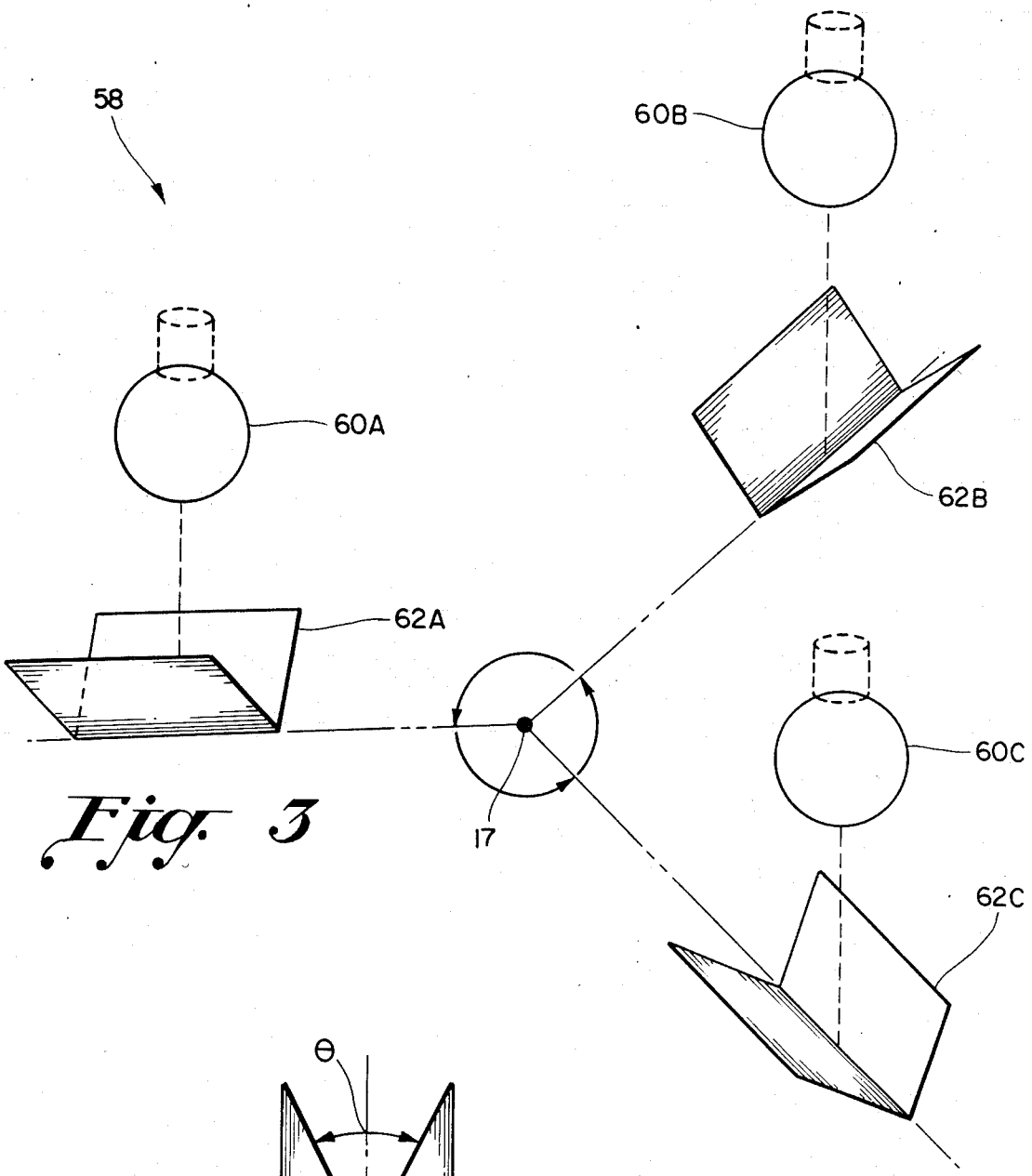
FIG. 3 is a highly schematic pictorial representation in perspective depicting indexing means according to the invention.

NOTE: With reference now to the schematic representation, FIG. 3, please note that the balls are depicted schematically by the dash line "pegs" as being fixed; that is, non-rolling. In lieu of balls, the indexing means according to the invention could as well comprise rounded protuberances fixed in one of the sealing areas.

58 indexing means. Indexing means according to the invention consisting of the following components:

60A, 60B, 60C. Represented as being three balls (alternately, rounded protuberances) fixed in the sealing area of a first component which can be e.g., a faceplate, or a funnel, or a frame holding a shadow mask (see FIG. 6), and in apposition to and for mating in registration with—

Figure 4:
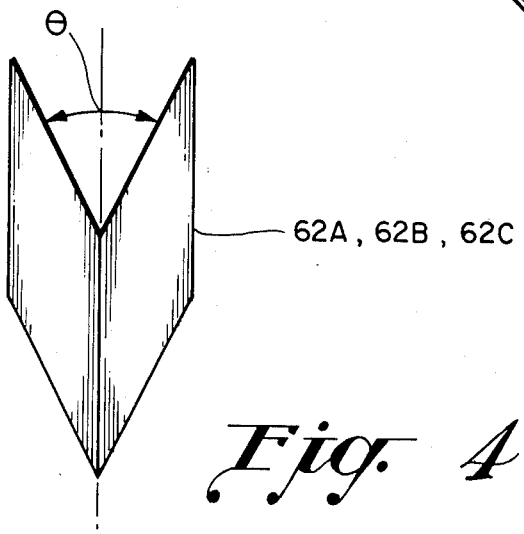
FIG. 4 is a schematic view in perspective of a V-groove having a subtended angle of desired degree value according to the invention.

62A, 62B, 62C V-grooves. For mating in registration with the indexing means 60A, 60B and 60C in a second of the components; e.g., a faceplate or a funnel. Each of the grooves 62A, 62B and 62C according to the invention has a subtended angle in the range of 34 to 75 degrees, and preferably about 53 degrees. The angle, identified as $\theta$, is indicated in FIG. 4.

Rationale

Exact and repeatable registration of the shadow mask with the faceplate is essential both in the photoscreening process, and in the final assembly of the tube components. Precision in registration is particularly important in the tension foil shadow mask tube wherein the allowable tolerance in registration of the mask with the faceplate screen may not e.g. exceed $\pm 0.0006$ inch. The indexing means according to the present invention, and the means described and claimed in the referent copending applications, can provide the necessary precision in component registration in the manufacture of CRTs that have the tension foil shadow mask.

A problem was encountered in practice, however, in that one of the indexing protuberances or balls would often "hang up" or refuse to seat in its associated groove, especially in the presence of the devitrifying frit which is in a viscous state during the registration process. (The frit is hardened in final assembly.) Which of the three balls failed to seat was typically not known. The failure was attributed to the relatively high coefficient of friction between the balls and the walls of the associated V-grooves. In cases where the balls would not seat properly, the application of greater pressure was unavailing; i.e., a "self-locking" situation was in evidence. It is to be noted that when the balls are affixed in one rigid body, there must motion of all three balls relative to the respective grooves in the opposite rigid body during seating, and this relative motion gives rise to sliding friction, and not rolling friction.

The inventive solution lay in determining the V-groove angles that could provide registration under a condition of maximum coefficient of friction. An optimum V-groove angle according to the invention can tolerate a high coefficient of friction without hang up.

Figure 5:
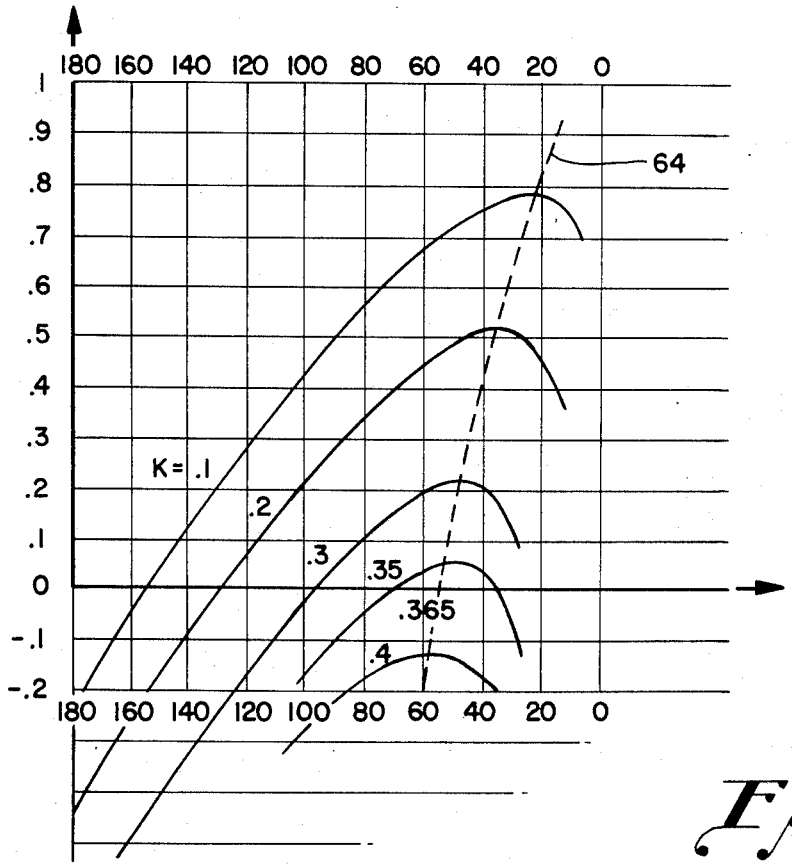
FIG. 5 is a group of curves that define the parameters of the desired V-groove angle according to the invention.

With reference now to FIG. 5, there is shown a family of curves which are the product of a series of mathematical computations leading to the preferred values of the V-groove angle according to the invention. The mathematical derivation of the optimum wedge angle is rather involved, but a qualitative explanation of why an optimum exists is readily understood. In FIG. 5, the x-axis represents the groove angle ($\theta$ in FIG. 4), while the y-axis represents the excess slant force, as will be explained infra. K is the coefficient of friction between ball and groove wall, and dash line 64 represents the locus of the maxima of the curves. Locus line 64 will be noted as intersecting the x-axis at about 53 degrees.

Assume that two of the three balls are seated in their grooves with each ball making contact with both walls of its respective groove, but the third ball rests along one of the sloping walls of its groove. For this ball to slide down and make contact with the opposite wall, the faceplate has to rotate slightly, and the two balls which are already fully seated must slide a short distance along their grooves. The driving force required to overcome the friction of all three balls stems from the slope along which the unseated ball is to slide down; the steeper the wall, the more the driving force. On the other hand, the friction of the two balls which are already seated increases as the walls are made steeper. Computation shows that for a wedge angle between groove walls of about 53 degrees, sliding will occur if the coefficient of friction is 0.366 or less. For any other angle, friction must be less to allow sliding. Therefore, a groove angle of 53 degrees represents an optimum choice.

This behavior is illustrated in the computed curves of FIG. 5. It is assumed that the three balls form an equilateral triangle; that is, that they are equiangularly spaced about the periphery of the component to be registered. The ratio of the excess slant force available at the unseated ball to the force acting to push the ball into the groove (e.g. one-third of the weight of the faceplate) is plotted against the groove angle $\theta$. Whenever this ratio is positive, sliding results; when it is negative, sliding is impossible.

The optimum V-groove angle according to the invention makes allowance for an increase of as much as 15 percent in the coefficient of friction over the conventional 90 degree groove angle traditionally used in ball-and-groove indexing means. With reference to FIG. 5, it will be seen that the maximum allowable coefficient of friction for a 90 degree groove angle is about 0.32. The maximum allowable coefficient of friction for a 53 degree groove angle according to the invention is about 0.366, about 15 percent larger than 0.32. This very substantial improvement makes feasible the precise registration of components of the cathode ray tube.

The precise optimum "wedge" angle is $\theta = 53.006$ degrees. The angle allows a friction of $K = 0.365$. A reasonable range of wedge angles according to the invention would include those which are accomodated by a five percent reduction in friction. Now $0.3656 \times 0.95 = 0.3473$; computation shows that a curve drawn for $K = 0.3473$ would intercept the horizontal axis at $\theta = 34.2307$ degrees, and at 74.8346 degrees. A range from 34 degrees to 75 degrees, preferably 53 degrees, is therefore claimed. Note that this range does not include the wide angle of 90 degrees in common use.

Precision Photoscreening Application

Figure 6:
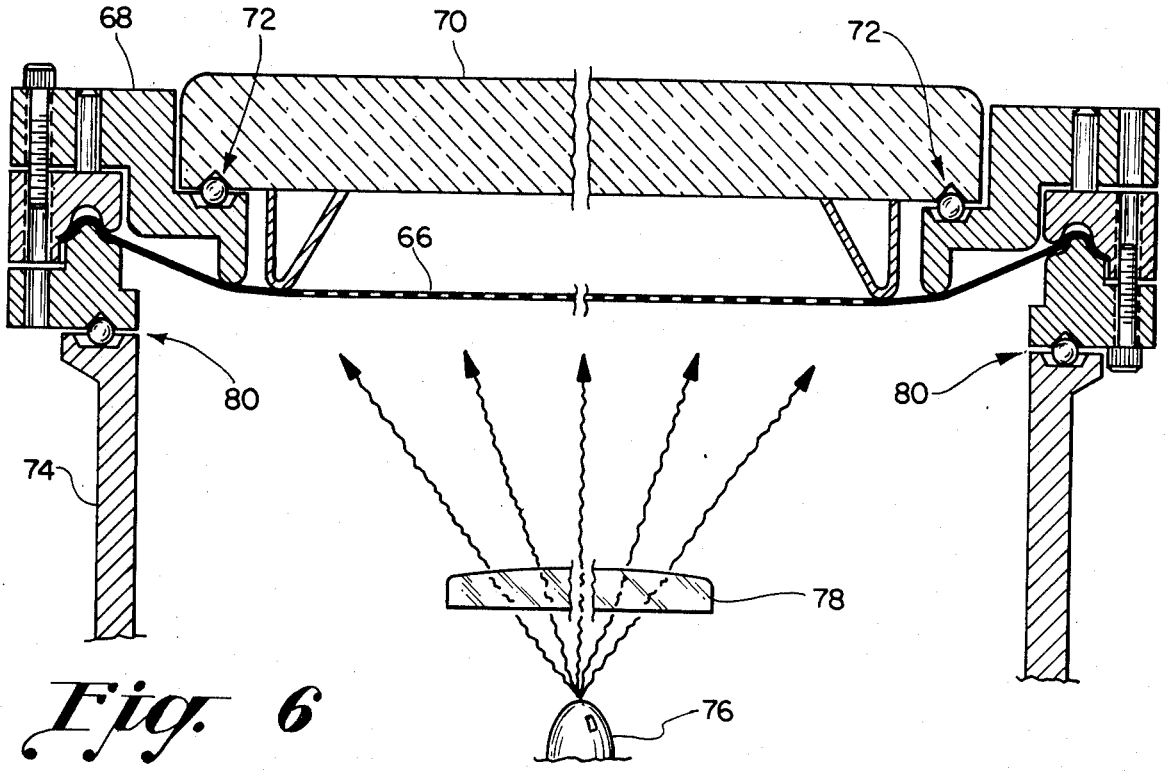
FIG. 6 is a view in section and in elevation that depicts the application of the indexing means according to the invention as used for indexing a faceplate and a tension foil shadow mask in preparation for photoscreening.

A suitable apparatus for such screening is shown by FIG. 6, wherein a shadow mask 66 is depicted as being stretched by a frame 68 across the inner surface of a faceplate 70. This apparatus is fully described and claimed in referent copending application Ser. No. 831,696 of common ownership herewith. The faceplate 70 is indicated as being held in registration with the frame 68 by the indexing means 72 according to the invention. The frame 68 is supported by the walls 74 of a lighthouse which includes a lamp 76 and a correction lens 78 used for irradiating the inner surface of the faceplate with actinic light, as is well know in the art. The frame 68 may as well be held in registry with the lighthouse by indexing means 80 according to the invention, although the requirement for exact registration is not as severe as for mask-to-faceplate registration.

Alternate Embodiment

The indexing means according to the invention could as well comprise three pairs of V-grooves in facing relationship, each having a ball therebetween, with the pairs being located in mutual apposition in the sealing areas of the components to be mated. The indexing means according to the invention are characterized by the V-grooves having a subtended angle in the range of 34 to 75 degrees. The indexing means according to the present invention is applicable to the ball-and-groove indexing means described and claimed in various of the referent copending applications including Ser. Nos. 729,015; 727,486; 758,174; 754,787; and 754,786; also, U.S. Pat. Nos. 4,547,696 and 4,595,857, all of common ownership herewith.

Figure 7:
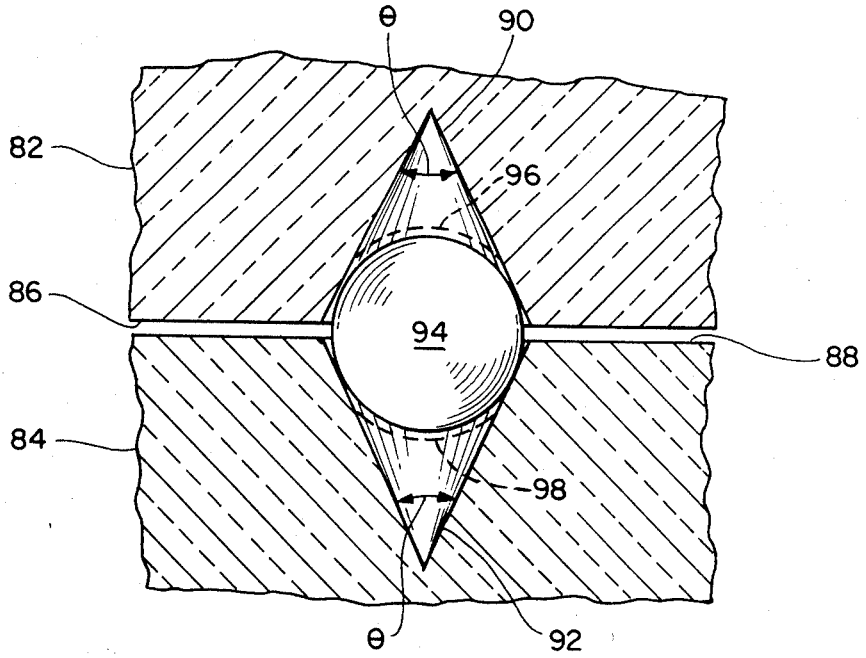
FIG. 7 is a sectional view in elevation showing details of another embodiment of the indexing means according to the invention.

One of such pairs of V-grooves in facing relationship having a configuration according to the invention is depicted in FIG. 7. Two components are shown which may comprise a faceplate 82 and a shadow mask frame 84 each having respective sealing areas 86 and 88. A pair of identical V-grooves 90 and 92 are shown in facing relationship with a ball 94 therebetween. The pair of grooves 90 and 92 are indicated as being in mutual appposition in the sealing areas 86 and 88 of the components 82 and 84 to be mated. Each of the V-grooves 90 and 92 has a subtended angle of 53 degrees according to the invention, as indicated by the angles $\theta$.

Materials and Manufacturing Techniques

In applications of the invention wherein cathode ray tubes are manufactured, it is important that the ball means which form a part of the indexing elements be formed from a composition which has a thermal coefficient of expansion compatible with the glass of the tube envelope. Such compatibility is required as the balls may ultimately be sealed between the sealing areas at a relatively high temperature. Also, the composition of the balls must be stable as their diameter determines the Q-spacing between shadow mask and screen. The balls are preferably formed of a ceramic such as forsterite, and finish-ground by means well-known in the art. Sphericity tolerance is preferably $\pm 0.000050$ inch. If protuberances are used in lieu of balls, they too must meet the material and dimensional constraints described.

The V-grooves and trihedral cavities may be formed by a tool having the desired shape, and which is vibrated ultrasonically in the presence of an abrasive slurry. It is not necessary that the V-grooves extend to the full depth of the angle; as depicted by the dash lines 96 and 98 in FIG. 7, the depth of the depression need only be deep enough to accomodate the ball. This limitation applies to the trihedral cavities as well. The absence of a sharp termination in the cavity is also of value in that there is no point of stress concentration that could initiate fracture of the glass.

While a particular embodiment of the invention has been shown and described, it will be readily apparent to those skilled in the art that changes and modifications may be made in the inventive means without departing from the invention in its broader aspects. For example, while the indexing means are particularly suited for television manufacturing, the invention can have broader application in other apparati requiring precision registration, such as laboratory instrumentation, which can be precisely registered by the indexing means according to the invention. If an instrument has two components having planar areas to be mated, three V-grooves can be located in the mating area of a first of the components, and three indexing protuberances or balls can be fixed in the mating area of a second of the components in apposition to the V-grooves for mating in registration with the V-grooves. The indexing means according to the invention is characterized by the grooves each having a subtended angle in the range of 34 to 75 degrees, and preferably about 53 degrees. The aim of the appended claims is to cover all such applications and other changes and modifications as fall within the true spirit and scope of the invention.

We claim:

1. A faceplate component and an envelope component for a color cathode ray tube having indexing means for registering one component with the other, the indexing means comprising at least one V-groove having a subtended angle in the range of 34 to 75 degrees.

2. The components according to claim 1 wherein said subtended angle is an angle of about 53 degrees.

3. Components of a color cathode ray tube including at least a faceplate, a frame, and a funnel with mutual sealing areas, said components having indexing means for use in the manufacture and assembly of the components, said indexing means comprising three V-grooves located in the sealing area of a first of said components, and three indexing protuberances in the sealing area of a second of said components in apposition to said V-grooves for mating in registration with said V-grooves, said indexing means being characterized by said grooves each having a subtended angle in the range of 34 to 75 degrees.

4. The indexing means according to claim 3 wherein said subtended angle is an angle of about 53 degrees.

5. The indexing means according to claim 3 wherein said indexing protuberances consist of ball means fixed in the sealing area of the second of said components.

6. In a cathode ray tube, the apparatus comprising:

a faceplate having a centrally disposed phosphor target encircled by a sealing area with first indexing means therein;

a funnel having a sealing area mating with said sealing area of said faceplate and having second indexing means, one of said first and second indexing means comprising three angularly spaced and approximately radially oriented V-grooves, and the other comprising three rounded indexing elements fixed in said sealing area in apposition to said V-grooves for mating with said V-grooves.

said cathode ray tube being characterized by said V-grooves having a subtended angle in the range of 34 to 75 degrees.

7. The cathode ray tube according to claim 6 wherein said subtended angle is an angle of about 53 degrees.

8. Indexing means for use in the manufacture and assembly of components of a color cathode ray tube for indexing said components, said components comprising at least a faceplate, a shadow-mask frame, and a funnel, with each component having at least one sealing area for mating with the sealing area of another component, said indexing means comprising three pairs of V-grooves in facing relationship each having a ball therebetween, said pairs being located in mutual apposition in the sealing areas of the components to be mated, said indexing means being characterized by said V-grooves each having a subtended angle in the range of 34 to 75 degrees.

9. The indexing means according to claim 8 wherein said subtended angle is an angle of about 53 degrees.

10. Indexing means for use in the indexing of components having planar mating areas, said indexing means comprising three V-grooves located in the mating area of a first of said components, and three indexing protuberances fixed in the mating area of a second of said components in apposition to said V-grooves for mating in registration with said V-grooves, said indexing means being characterized by said grooves each having a subtended angle in the range of 34 to 75 degrees, said indexing means being especially suited for application to television manufacturing.

11. The indexing means according to claim 10 wherein said subtended angle is an angle of about 53 degrees.

12. The indexing means according to claim 10 wherein said indexing protuberances comprise ball means fixed in the mating area of said second component.

* * * * *